US005178355A

United States Patent [19]

Herzig

[11] Patent Number: 5,178,355

[45] Date of Patent: Jan. 12, 1993

[54] MOUNTING DEVICE

[76] Inventor: Ernest Herzig, 30 Sutcliffe Drive, Willowdale, Ontario, Canada, M2K 2A6

[21] Appl. No.: 709,477

[22] Filed: Jun. 3, 1991

[51] Int. Cl.[5] ..... A47G 1/16

[52] U.S. Cl. ..... 248/489; 248/493

[58] Field of Search ..... 248/489, 493, 497, 498, 248/475.1

[56] References Cited

U.S. PATENT DOCUMENTS

| | | | |
|---|---|---|---|
| 1,272,696 | 7/1918 | Mock . | |
| 1,292,956 | 1/1919 | McConnal | 248/489 |
| 1,887,159 | 11/1932 | Knight . | |
| 2,049,716 | 8/1936 | Owen | 248/489 |
| 2,384,478 | 9/1945 | Lapeyre . | |
| 2,448,137 | 8/1948 | Cody . | |
| 3,063,669 | 11/1962 | Bell . | |
| 3,298,655 | 1/1967 | Palm . | |
| 3,552,708 | 1/1971 | Hillstrom . | |
| 3,861,631 | 1/1975 | Shorin | 248/489 X |
| 3,861,639 | 1/1975 | Morrill . | |
| 3,911,516 | 10/1975 | Einhorn . | |
| 3,995,821 | 12/1976 | Einhorn . | |
| 4,026,510 | 5/1977 | Holmes . | |
| 4,083,525 | 4/1978 | Rath . | |

FOREIGN PATENT DOCUMENTS

| | | | |
|---|---|---|---|
| 70562 | 11/1915 | Fed. Rep. of Germany | 248/489 |
| 666154 | 5/1929 | France | 248/489 |
| 2333473 | 7/1977 | France | 248/489 |

*Primary Examiner*—Carl D. Friedman
*Assistant Examiner*—Derek J. Berger
*Attorney, Agent, or Firm*—Bereskin & Parr

[57] ABSTRACT

A picture hanging device for use with or without pictures having elongate support means. The device has a curved surface for supporting a picture wire in an unstressed and even manner and adjacent thereto, and a lip and a straight, support surface for supporting a frame directly. The device is fastened to a surface and an article, such as a picture, is then fastened to the device using the curved surface, or straight, support surface.

15 Claims, 1 Drawing Sheet

MOUNTING DEVICE

FIELD OF THE INVENTION

This invention relates generally to a device for mounting articles on a surface and specifically to a device that allows for the simple and secure mounting of a picture with or without the use of a picture hanging wire.

BACKGROUND OF THE INVENTION

At present, it is common to use at least one nail driven into a surface. A picture wire is then hung on the nail. Typically, more than one nail is used to avoid a stressed or sharp juncture in the picture wire and to provide greater security. Obviously, this approach requires the mounting of a picture wire to the article before fastening to the surface may take place. The precise placement of the nail in order to accomplish the desired mounting position also presents some difficulty. Further, the placement of numerous nails to avoid sharp curves in the wire is time consuming and requires careful placement of the nails.

Various devices for solving these problems have been proposed. U.S. Pat. No. 1,272,696 to Mock, shows a pushpin hanger with a detachable head. U.S. Pat. Nos. 3,911,516 and 3,995,821 to Einhorn show pushin picture hanging devices but do not provide a means for the precise mounting of the device to the wall. Similarly, U.S. Pat. Nos. 4,026,510 to Holmes and 3,063,669 to Bell both show devices for mounting a picture wire that avoids sharp curves in the wire. However, neither the Einhorn, Mock, Holmes nor Bell patents show a device that may be used with or without a picture hanging wire at the discretion of the user.

U.S. Pat. Nos. 1,887,159 to Knight and 2,448,137 to Cody show article and picture hangers, which utilize the square or rectangular frame of a picture etc. The hangers engage a straight, upper edge of the frame, to maintain the picture level.

A major disadvantage of these prior art devices is their lack of adaptability. Thus each device is designed for a particular mounting method. It is desirable that a mounting device should enable different articles to be mounted in different ways.

Accordingly, it is an object of the present invention to provide an improved secure mounting device that allows for the mounting of articles with reasonable precision with or without a mounting wire.

In its broadest aspect, the present invention provides a device which has a body comprising: a supporting means which includes a support surface for supporting an edge of a frame, the surface being straight and extending transversely and an upwardly extending lip for retaining such a frame on the device; a hanging means including a downwardly curved surface for uniformly supporting and retaining an elongate support element of an article; and a flat face for abutting a surface to which the device is secured.

In accordance with another aspect with the present invention there is provided a method for securing an article to a surface comprising the following steps:

(1) selecting the desired location on a surface with reference to a top edge of the article, (2) positioning against the surface a device as defined above, (3) fastening the body to the surface, (4) engaging the article on either the curved surface by means of an elongate element of the article, or on the straight, support surface thereby supporting the article.

Because the present invention may be used alternatively with or without a mounting wire, at the option of the user, the device facilitates the mounting of most articles without requiring adjustment or manipulation of the article to be mounted. It may be desirable, depending upon the shape and weight of the article to be mounted, to use more than one of the devices to ensure the secure mounting of the article to the surface.

BRIEF DESCRIPTION OF THE DRAWINGS

A better understanding of the invention will be had by reference to the following description of preferred embodiments of the invention taken together with the accompanying drawings in which.

DESCRIPTION OF PREFERRED EMBODIMENTS

Figure 5:
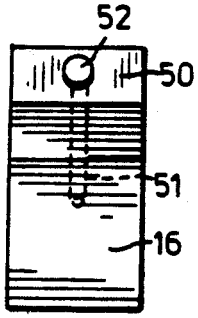
FIG. 5 is a front view of the device.
Figure 6:
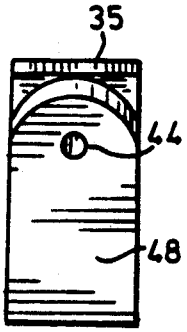
FIG. 6 is a rear view of the device.

With reference to FIGS. 1–6, the device is indicated generally by the reference 10. The device 10 has a body 22 comprising a lower body portion 11 and an upper body portion 12. The body portions 11, 12 have the same width, as indicated in FIGS. 5 and 6.

The lower body portion 11 is bounded on its sides by trapezoidal side surfaces 14. It also has a rectangular bottom surface 15 and a larger rectangular front surface 16. The front surface 16 extends upwards and is inclined slightly outwardly. A planar, mounting face or surface 48 extends vertically, and is common to the lower and upper body portions 11, 12.

The upper body portion 12 includes planar side surfaces 18, which are continuous with the side surfaces 14. The upper body portion 12 also has a rectangular face 64, which is inclined outwardly at an angle relative to the front face 16. A striking surface 50 extends upwardly and rearwardly from the front face 64.

The upper part of the flat mounting surface 48 defines the rear of a tongue 26. The tongue 26 is of uniform thickness and has a planar front face. In front of the tongue 26, there is a curved surface 24, which, in section, is approximately hemispherical. As shown in FIG. 4 and the section of FIG. 3, the top of the curved surface 24 is inclined downwards towards the tongue 26. The surface 24 and the tongue 26 meet at an acute angle to form a juncture 28, for receiving a picture mounting wire as described below. The curved surface 24 may be wholly, or partially, frustroconical, to provide this effect.

In front of the curved surface 24, there is a planar support surface 32, which extends horizontally. A lip 34 extends upwardly, in front of the support surface 32. The rear of the lip 34 is defined by a vertical surface 35, whilst the front of the lip 34 is defined by the upper part of the striking surface 50. The lip 34 also includes a narrow, top surface 37, as shown. As detailed below, the flat support surface 32 and the lip 34 provide a supporting arrangement for a frame.

Figure 3:
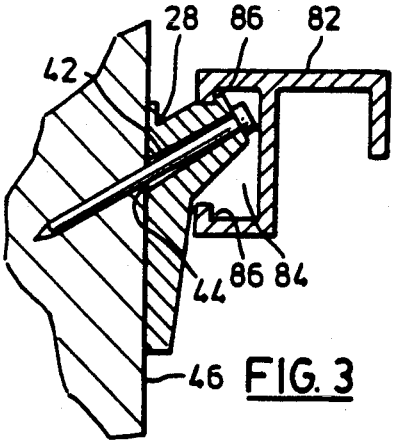
FIG. 3 is a vertical section of the device and frame member of FIG. 1.
Figure 4:
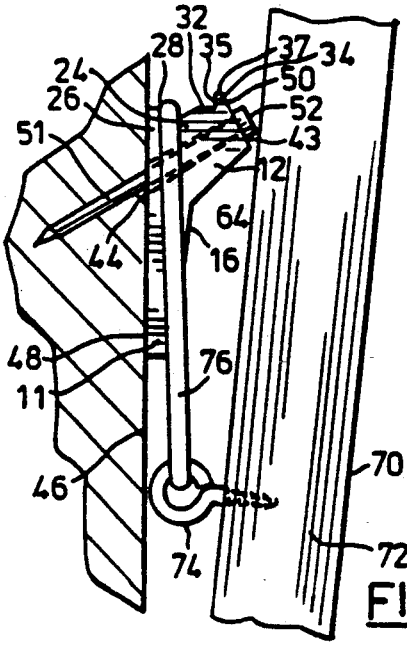
FIG. 4 is a side view of the device showing a picture hanging wire and part of a frame.

A conical passage 42 extends at an angle downwardly and rearwardly through the body 22 from the striking surface 50, as best shown in FIG. 3. The passage 42 is perpendicular to the striking surface 50, and is intended to accommodate a nail 51. The passage 42 includes an exit aperture 44 and entrance aperture 43. The exit aperture 44 is located near the middle of the mounting face 48 and is of a larger area than entrance aperture 43. The conical shape of the passage 42 facilitates the flush mounting of the device to a mounting surface 46 where the surface is not flat. The conical shape of the passage allows the device 10 to settle straight and flush to the mounting surface 46.

In use, the device 10 is located on the mounting surface 46 of a wall, at a desired location. It is then secured in position by a nail 51. The nail 51 is located in the passage 42, which serves to hold it in the correct position, whilst the nail 51 is driven home. As the nail 51 is hammered in place, the flat mounting face 48 serves to support the wall material surrounding the mounting location. This prevents instability and damage to the wall or mounting surface, such as crushing in the case of drywall, that otherwise could occur. When the nail 51 is fully driven home, its head 52 abuts the striking surface 50, as shown in FIG. 3. In this configuration, the face 48 is uniformly pressed against the mounting surface 46.

The device 10 then provides a mount, for either a mounting wire or the like of a picture, or directly for a frame of a picture or other article.

For an article with a mounting wire, FIG. 4 shows the mounting arrangement. The article as a whole is indicated by the reference 70. It includes a frame 72 and mounting eyes 74 in known manner. A mounting wire 76 extends between the eyes 74 around curved surface 24. As shown in FIG. 4, the curved surface 24 uniformly supports the mounting wire 76, without stressing it, or causing any sharp curves or kinks in it. Further, as shown, the mounting wire 76 fits snugly in the juncture 28 between the surface 24 and the tongue 26, thereby keeping the mounting wire 76 close to the wall. This provides a secure mounting for the article 70. The horizontal alignment of the article 70 can be readily adjusted, by slight movement of the wire 76 across the surface 24.

Figure 1:
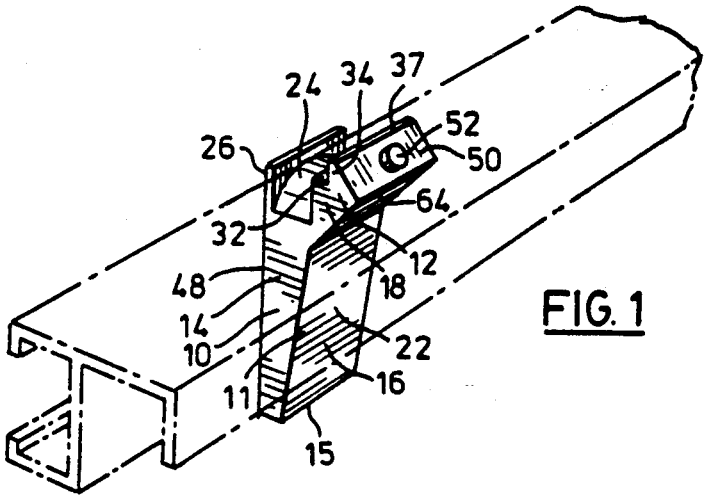
FIG. 1 is a perspective view of a device according to the present invention, in operation, with a frame member shown in outline.
Figure 2:
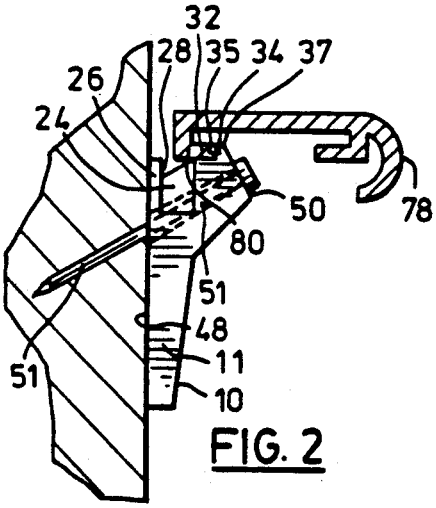
FIG. 2 is a side view of the device, and a sectional view of a frame member.

Now, in the case of an article having a frame 78, the mounting device 10 enables such an article to be mounted directly. As shown in FIG. 2, the frame 78 includes a forwardly directed lip 80 at the rear thereof. This lip 80 is located on the flat support surface 32, abutting the lip 34. This provides a uniform, secure mounting for the article. As the flat support surface 32 is horizontal, this will automatically ensure that the article itself is located horizontally, provided its centre of gravity is located within the width of the device 10. In other words, the device 10 automatically allows for some mispositioning of the article placed on it.

FIG. 3 shows the mounting arrangement for a different type of frame. Here, a frame 82 includes a rearwardly open channel 84. On either side of the channel there are lips 86 facing each other. The upper lip extends downwards, and is engaged on the flat support surface 32. As before, it is supported on the surface 32, and retained by the lip 34.

It is to be appreciated that, in FIGS. 2 and 3, only an upper member of the frames 78, 82 are shown, for simplicity. The frames, usually, will be rectangular with all sides formed from similar frame members.

Figure 7:
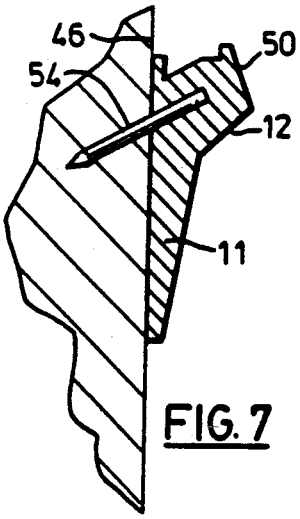
FIG. 7 is a vertical section of an alternative embodiment of the device.

Reference will now be made to FIG. 7, which shows an alternative embodiment. Here, the body of the device 10 is generally similar to that shown in the first embodiment, and again it includes the upper and lower body portions 11, 12. Here, the passage 42 is omitted. Instead, a protruberance 54 extends at the same angle as the passage 42. Thus, the protruberance 54 is perpendicular to the striking surface 50. The upper end of the protruberance 54 is securely mounted within the body, whilst the lower end is sharpened. To mount this variant device, it is simply located against the mounting surface 46 and the striking surface 50 struck with a hammer, until the face 48 abuts the mounting surface 46. Thus, the protruberance 54 acts as an integral nail.

It is of course to be understood that the preceding description relates to particular preferred embodiments of the invention and that various modifications are possible within the broad scope of the invention. For example, as described in reference to FIG. 1, the precise shape of the curved surface 24 may be altered, while still preserving the ability of the device to support a picture wire or the like in an unstressed manner. Similarly, the configuration of the support surface 32 and the upwardly extending lip 34 may be modified to accommodate various types of frame channels. Finally, nail 51 may be replaced by a device or screw which will act to functionally attach device 10 to a mounting surface 46.

The embodiments of the invention in which an exclusive property or privilege is claimed are defined as follows:

1. A picture hanging device securable to a generally planar surface for subsequent hanging of a picture thereon, said device comprising:

a substantially flat rear face for abutting said surface, and a pair of side surfaces extending forwardly from said rear face;

a supporting means spaced forwardly of said rear face and including an upwardly extending lip for retaining the edge of a frame on said device, and a support surface adjacent and located rearwardly of said lip and beneath said lip, for supporting said edge of said frame, said lip extending upwardly above said rear face, said support surface being straight and extending between said side surfaces;

a hanging means including a downwardly curved surface behind said support surface for uniformly supporting and retaining an elongate support element of an article, said curved surface extending between said side surfaces and having an upper portion located substantially midway between said side surfaces, said curved surface curving smoothly downwardly from each side of said upper portion to join said side surfaces.

2. A combination of a device in claim 1 and a mounting means enabling the device to be mounted to a surface.

3. A device as claimed in claim 1, wherein said support surface is generally planar, horizontal and perpendicular to the said upwardly extending lip.

4. A device as claimed in claim 1, 2 or 3 wherein said downwardly curved surface slopes downwardly from said support surface towards said rear face, said curved surface having a lower rear edge, and wherein said hanging means includes an upwardly extending tongue portion joining with the lower edge of the said curved surface at an acute angle to form a juncture between said tongue portion and said curved surface wherein the said elongate support element may be retained.

5. A device as claimed in claim 4 and comprising an upper body portion, including the supporting means and the hanging means and the tongue portion, and a lower body portion extending below the upper body portion with said flat rear face being common to the lower and upper body portions.

6. A device as claimed in claim 5, wherein the lower and upper body portions are of uniform width.

7. A device as claimed in claim 6, wherein the lower body portion includes a first front surface which extends upwardly and is inclined forwardly at a first angle from the vertical.

8. A device as claimed in claim 7, wherein the upper body portion includes a second front surface which is inclined upwardly and forwardly from said first front surface at a second angle from the vertical, said second angle being greater than said first angle, said second front surface having an upper end, and a striking surface which extends upwardly and rearwardly from said upper end of said second front surface, said striking surface having an upper end, said upper end of said striking surface defining a portion of said lip.

9. A device as claimed in claim 8, which includes a passage, perpendicular to the striking surface, for receiving an elongate fastening means.

10. A device as claimed in claim 9, wherein said passage is of generally conical shape, increasing continuously in diameter from said striking surface towards said rear face.

11. A device as claimed in claim 8, including a nail means extending from the flat face perpendicularly to the striking surface.

12. A device as claimed in claim 1, 2 or 3, and comprising an upper body portion, including the supporting means and the hanging means, and a lower body portion, with said flat face being common to the lower and upper body portions.

13. A device as claimed in claim 2, said mounting means comprising an integral nail means, and said body having a striking surface normal to and surrounding the said integral nail means to allow for the driving of the nail means into a surface to which the device is to be secured.

14. A device as claimed in claim 2, wherein said mounting means includes an elongate fastening means and said body has a passage adapted to receive the fastening means.

15. A device as claimed in claim 14, further comprising a flat striking surface, said striking surface surrounding and being normal to the said passage.

* * * * *